350-3.82 $$$ SR
4/11/78 XR 4,084,255

United States Patent [19] [11] 4,084,255
Casasent et al. [45] Apr. 11, 1978

[54] POSITIONAL, ROTATIONAL AND SCALE INVARIANT OPTICAL CORRELATION METHOD AND APPARATUS

[75] Inventors: David Paul Casasent, Pittsburgh, Pa.; Demetri Psaltis, Thessaloniki, Greece

[73] Assignee: The United States of America as represented by the Secretary of the Navy, Washington, D.C.

[21] Appl. No.: 738,781

[22] Filed: Nov. 2, 1976

[51] Int. Cl.[2] ..... G06G 7/19; G06G 9/00

[52] U.S. Cl. ..... 364/822; 340/146.3 Q; 350/3.82; 350/162 SF; 364/515; 364/826

[58] Field of Search ..... 235/181, 197–198; 340/146.3 Q; 350/162 SF; 364/826, 827, 822

[56] References Cited

U.S. PATENT DOCUMENTS

| | | | |
|---|---|---|---|
| 3,614,736 | 10/1971 | McLaughlin | 340/146.3 Q |
| 3,772,563 | 11/1973 | Hasenbalg | 235/198 |
| 3,776,616 | 12/1973 | Douklias | 350/162 SF |
| 3,794,406 | 2/1974 | Kock et al. | 350/162 SF |
| 3,872,293 | 3/1975 | Green | 235/181 |
| 3,891,968 | 6/1975 | McMahon | 350/162 SF |
| 3,903,407 | 9/1975 | Burnham | 235/181 |

OTHER PUBLICATIONS

Beard, Imaging by correlation of intensity Fluctuations, Applied Physics Letters, vol. 15, No. 7, Oct. 1969, pp. 227–229.

Gerardi: Application of Mellin and Hankel Transforms to Networks with Time-Varying Parameters, IRE Transactions on Circuit Theory, vol. CT-6, June 1959, pp. 197/208.

Baudelaire: Linear Stretch-Invariant Systems, Proceedings IEEE vol. 61, Apr. 1973, pp. 467, 468.

Robbins: Inverse Filtering for Linear Shift-Variant Imaging Systems, Proceedings of the IEEE, vol. 60, No. 7, July 1972, pp. 862–872.

*Primary Examiner*—Felix D. Gruber
*Attorney, Agent, or Firm*—R. S. Sciascia; L. I. Shrago

[57] ABSTRACT

A method and electro-optical apparatus for correlating two functions, $f_1(x,y)$ and $f_2(x,y)$ which are shifted, scaled and rotated versions of each other without loss of signal-to-noise and signal-to-clutter ratios as compared to the autocorrelation case. The coordinates of two correlation peaks provide an indication of the scale and orientation differences between the two functions. In performing the method, the magnitudes of the Fourier transforms of the functions are obtained, $|F_1(\omega_x, \omega_y)|$ and $|F_2(\omega_x,\omega_y)|$ and then a polar coordinate conversion is performed, and the resultant functions $F_1(r,\theta)$ and $F_2(r,\theta)$ are logarithmically scaled in the $r$ coordinate. The functions thus produced $F_1(e^\rho,\theta)$ and $F_2(e^\rho,\theta)$ are Fourier transformed to produce the Mellin transforms $M_1(\omega_\rho, \omega_\theta)$ and $M_2(\omega_\rho,\omega_\theta)$. The conjugate of one of these Mellin transforms is obtained, and the product of this conjugate with the other Mellin transform is produced and, subsequently, Fourier transformed to complete the correlation process.

10 Claims, 4 Drawing Figures

POSITIONAL, ROTATIONAL AND SCALE INVARIANT OPTICAL CORRELATION METHOD AND APPARATUS

The present invention relates generally to optical pattern recognition systems, and, more particularly, to optical correlation apparatus and methods utilizing transformations that are shift, scale and rotationally invariant.

In the correlation of 2-D information, the signal-to-noise ratio of the correlation peak decreases significantly when there are scale and rotational differences in the data being compared. For example, in one case of a 35 mm transparency of an aerial image with about 5 to 10 lines/mm resolution, this ratio decreased from 30 db to 3 db with a 2 percent scale change and a similar amount with a 3.5° rotation.

Several methods have been advanced for overcoming the signal losses associated with the scale, shift and rotational discrepancies encountered in optical comparison systems. One proposed solution involves the storage of a plurality of multiplexed holographic spatial filters of the object at various scale changes and rotational angles. Although theoretically feasible, this approach suffers from a severe loss in diffraction efficiency which is proportional to the square of the number of stored filters. In addition, a precise synthesis system is required to fabricate the filter bank, and a high storage density recording medium is needed.

A second proposed solution involves positioning the input behind the transform lens. As the input is moved along the optic axis the transform is scaled. Although useful in laboratory situations, this method is only appropriate for comparatively small scale changes, i.e., 20 percent or less. Also, since this method involves mechanical movement of components, it cannot be employed in those applications where the optical processor must possess a real time capability.

Mechanical rotation of the input can, of course, be performed to compensate for orientation errors in the data being compared. However, the undesirable consequences of having to intervene in the optical system are again present.

In applicants' co-pending application, Ser. No. 707,977, filed July 23 1976, there are disclosed correlation methods and apparatus which use Mellin transforms that are scale and shift invariant to compensate for scale differences in the data being compared. The systems therein disclosed, however, do not compensate for orientation errors in this data.

It is, accordingly, an object of the present invention to provide a transformation which is invariant to shift, scale and orientational changes in the input.

Another object of the present invention is to provide an optical correlation method and apparatus for use with 2-D data having shift, scale and rotational differences.

Another object of the present invention is to provide a method of cross-correlating two functions which are scale and rotated versions of one another where the correlation peak has the same signal-to-noise ratio as the autocorrelation peak.

Another object of the present invention is to provide an electro-optic correlator whose performance is not degraded by scale and orientational differences in the data being compared and which provides information indicative of the magnitudes of these differences.

Other objects, advantages and novel features of the invention will become apparent from the following detailed description of the invention when considered in conjunction with the accompanying drawings wherein.

Figure 1:
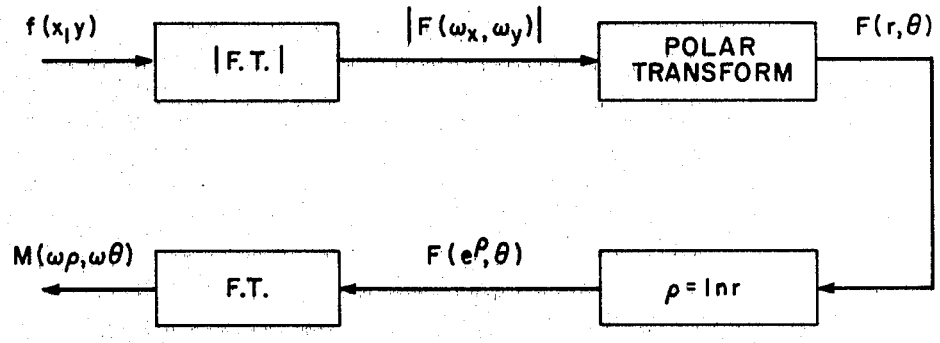
FIG. 1 is a block diagram illustrating a positional, rotational and scale invariant transformation system.

The present invention provides a solution for the shift, scale and rotational differences between the input and reference data by utilizing a transformation which is itself invariant to shift, scale and orientational changes in the input. As shown in FIG. 1, the first step in the synthesis of such a transformation is to form the magnitude of the Fourier transform $|F(\omega_x,\omega_y)|$ of the input function $f(x,y)$. This eliminates the effects of any shifts in the input and centers the resultant light distribution on the optical axis of the system.

Any rotation of $f(x,y)$ rotates $|F(\omega_x,\omega_y)|$ by the same angle. However, a scale change in $f(x,y)$ by "$a$" scales $|F(\omega_x,\omega_y)|$ by $1/a$.

The effects of rotation and scale changes in the light distribution resulting from the Fourier transform of $f(x,y)$ can be separated by performing a polar transformation on $|F(\omega_x,\omega_y)|$ from $(\omega_x,\omega_y)$ coordinates to $(r,\theta)$ coordinates. Since $\theta = \tan^{-1}(\omega_y/\omega_x)$ and $r = (\omega_x^2+\omega_y^2)^{\frac{1}{2}}$, a scale change in $|F|$ by "$a$" does not affect the $\theta$ coordinate and scales the $r$ coordinate directly to $r = ar$. Consequently, a 2-D scaling of the input function is reduced to a scaling in only one dimension, the $r$ coordinate, in this transformed $F(r,\theta)$ function.

If a 1-D Mellin transform in $r$ is now performed on $F'(r, \theta)$, a completely scale invariant transformation results. This is due to the scale invariant property of the Mellin transform.

The 1-D Mellin transform of $F(r, \theta)$ in $r$ is given by $$M(\omega_\rho,\theta) = -\int_0^\infty F(r,\theta)r^{(-j\omega_\rho-1)}\,dr. \tag{1}$$

where $\rho = ln\ r$. The Mellin transform of the scaled function $F'' = F(ar,\theta)$ is then $$M'(\omega_\rho,\theta) = a^{-j\omega}\rho M(\omega_\rho,\theta)$$

from which the magnitudes of the two transforms are seen to be identical. One arrangement for optically implementing the Mellin transform is disclosed in applicants' co-pending application, above-identified, and there it is shown that $$M(\omega_\rho,\theta) = \int_0^\infty F(\exp\rho,\theta)\exp(-j\omega_\rho)\,d\rho \tag{3}$$

where $\rho = ln\ r$. From equation (3), it can be seen that the realization of the required optical Mellin transform simply requires a logarithmic scaling of the $r$ coordinate followed by a 1-D Fourier transform in $r$. This follows from equation (3) since $M(\omega_\rho,\theta)$ is the Fourier transform of $F(\exp\rho,\theta)$.

The rotation of the input function $f(x,y)$ by an angle $\theta_0$ will not affect the $r$ coordinate in the $(r,\theta)$ plane. If, for example, the input $F(\omega_x,\omega_y)$ is partitioned into two sections $F_1(\omega_x,\omega_y)$, $F_2(\omega_x,\omega_y)$ where $F_2$ is a segment of F that subtends an angle $\theta_0$, the effects of a rotation by $\theta_0$ is an upward shift in $F_1(r,\theta)$ by $\theta_0$ and a downward shift in $F_2(r,\theta)$ by $2\pi - \theta_0$. Thus, while the polar transformation has converted a rotation in the input to a shift in the transform space, the shift is not the same for all parts of the function.

These shifts in $F(r,\theta)$ space due to a rotation in the input can be converted to phase factors by performing a 1-D Fourier transform on $F(r,\theta)$.

The final Fourier transform shown in FIG. 1 is a 2-D transform in which the Fourier transform in $\rho$ is accomplished to effect scale invariance by the Mellin transform and the Fourier transform in $\theta$ is used to convert the shifts due to $\theta_0$ to phase terms. The resultant function is, thus, a Mellin transform in $r$, and, hence, it is denoted by M in FIG. 1.

If the complete transformation of $f(x,y)$ is represented by $$M(\omega_\rho,\omega_\theta) = M_1(\omega_\rho,\omega_\theta) + M_2(\omega_\rho,\omega_\theta) \quad (4)$$

the transformation of the function $f'(x,y)$, which is scaled by "$a$" and rotated by $\theta_0$ is given by $$M'(\omega_\rho,\omega_\theta) = M_1(\omega_\rho,\omega_\theta)\exp[-j(\omega_\rho lna+\omega_\rho\theta_0)] + M_2(\omega_\rho,\omega_\theta)\exp\{-j[\omega_\rho lna-\omega_\theta(2\pi-\theta_0)]\} \quad (5)$$

The positional, rotational and scale invariant (PRSI) correlation is based on the form of equations (4) and (5). If the product $M^*M'$ is formed, we obtain $$M^*M' = M^*M_1\exp[-j(\omega_\rho lna+\omega_\theta\theta_0)] + M^*M_2\exp\{-j[\omega_\rho lna-\omega_\theta(2\pi-\theta_0)]\} \quad (6)$$

The Fourier transform of equation (6) is $$f_1 * f * \delta(\rho'-lna) * \delta(\theta'-\theta_0) + f * f_2 * \delta(\rho'-lna) * \delta(\theta'+2\pi-\theta_0) \quad (7)$$

The $\delta$ functions in equation (7) identify the locations of the correlation peaks, one at $\rho' = ln\ a$, $\theta' = \theta_0$; the other at $\rho' = ln\ a$, $\theta' = (2\pi+\theta_0)$. Consequently, the $\rho'$ coordinate of the peaks is proportional to the scale change "$a$" and the $\theta'$ coordinate is porportional to the rotational angle $\theta_0$.

The Fourier transform of equation (6) thus consists of two terms:

(a) the cross-correlation $F_1(\exp\rho,\theta) * F(\exp\rho,\theta)$ located, as indicated above, at $\rho' = ln\ a$ and $\theta' = \theta_0$;

(b) the cross-correlation $F_2(\exp\rho,\theta)\ F(\exp\rho,\theta)$ located at $\rho' = ln\ a$ and $\theta' = (2\pi+\theta_0)$, where the coordinates of this output Fourier transform plane are $(\rho',\theta')$.

If the intensities of these two cross-correlation peaks are summed, the result is the autocorrelation of $F(\exp\rho,\theta)$. Therefore, the cross-correlation of two functions that are scaled and rotated versions of one another can be obtained. Most important, the amplitude of this cross-correlation will be equal to the amplitude of the autocorrelation function itself.

Figure 2:
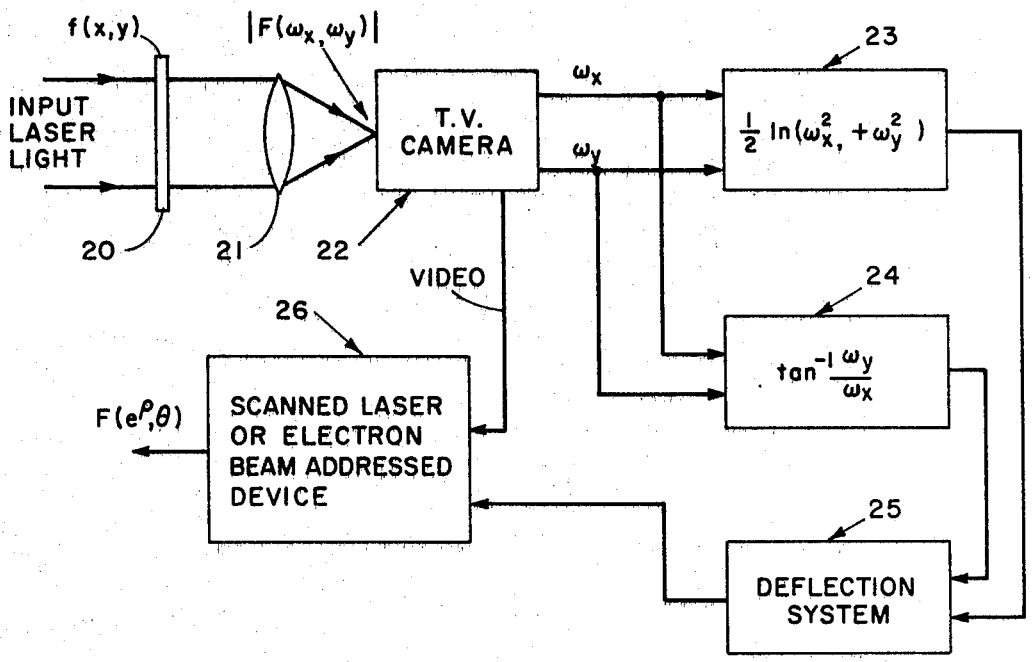
FIG. 2 is a block diagram illustrating the real time implementation of the transformation of FIG. 1.

Referring now to FIG. 2, which illustrates one electrooptical arrangement for implementing the positional, rotational and shift invariant transformation, the input $f(x,y)$, which may be recorded on a suitable transparency 20 or available in the form of an appropriate transmittance pattern on the target of an electron-beam-addressed spatial light modulator of the type described in the article, "Dielectric and Optical Properties of Electron-Beam-Addressed $KD_2PO_4$" by David Casasent and William Keicher which appeared in the December 1974 issue of the Journal of the Optical Society of America, Volume 64, Number 12, is here illuminated with a coherent light beam from a suitable laser not shown and Fourier transformed by a spherical lens 21. A TV camera 22 is positioned in the back focal plane of this lens and arranged such that the magnitude of the Fourier transform $[F(\omega_x,\omega_y)]$ constitutes the input image to this camera. As is well known, camera 22 has internal control circuits which generate the horizontal and vertical sweep voltages needed for the electron beam scanning, and these waveforms are extracted at a pair of output terminals as signals $\omega_x$ and $\omega_y$. The video signal developed by sanning the input image is also available at a third output terminal.

Horizontal and vertical sweep voltages $\omega_x$ and $\omega_y$ are subject to signal processing in the appropriate circuits 23 and 24 to yield the quantities $(\frac{1}{2})\ ln\ (\omega_x^2+\omega_y^2)$ and $\tan^{-1}(\omega_x/\omega_y)$, respectively. It will be recalled that the results of this signal processing, which may be performed in an analog or digital manner, is the polar coordinate transformation of the magnitude of the Fourier transform of the input function and its subsequent log scaling in $r$.

The function $F(e^\rho,\theta)$ is formed on the target of an EALM tube of the type hereinbefore referred to. In this regard, the video signal from camera 22 modulates the beam current of this tube while the voltages from circuits 23 and 24 control the deflection of the electron beam. Instead of utilizing an electron-beam-addressed spatial light modulator, an optically addressed device may be used wherein the video signal modulates the intensity of the laser beam while deflection system 25 controls its scanning motion. It would also be mentioned that the transformation can also be accomplished by means of computer generated holograms.

The function $M(\omega_\rho,\omega_\theta)$ is obtained by Fourier transforming $F(e^\rho,\theta)$ and this may be accomplished by illuminating the target of the EALM tube with a coherent light beam and performing a 2-D Fourier transform of the image pattern.

Figure 3:
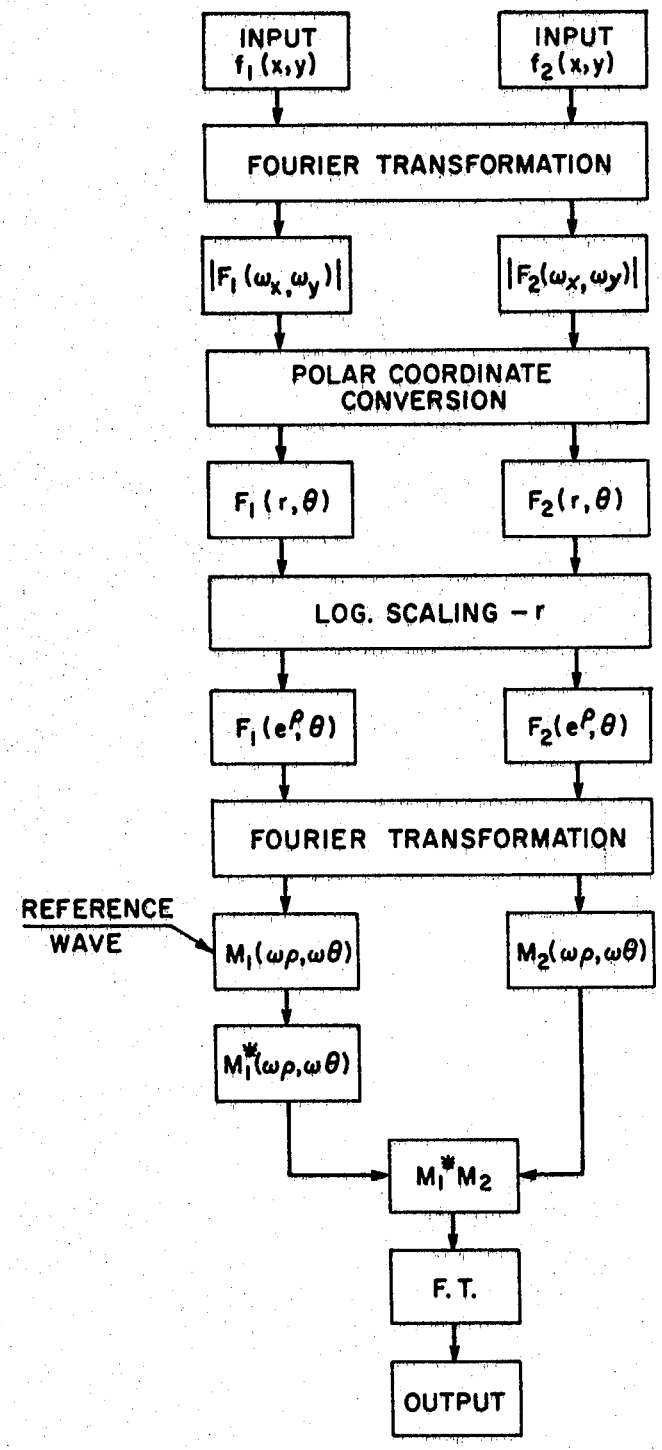
FIG. 3 shows the sequence of operations carried out in the cross-correlation method of the present invention.

FIG. 3 shows the sequence of steps involved in correlating two functions $f_1(x,y)$ and $f_2(x,y)$ that differ in position, scale and rotation. It would be mentioned that this method may be implemented by optical or digital means. Thus, all of the operations hereinafter set forth may be performed with a digital computer. However, the following description covers the optical process since it has greater utility in real time optical pattern recognition systems.

The first step of a method is to form the magnitude of the Fourier transform of both functions $|F_1(\omega_x,\omega_y)\}$ and $|F_2(\omega_x,\omega_y)\}$. This may be readily accomplished, as is well known, with a suitable lens and an intensity recorder with $\gamma = 1$. Next, a polar coordinate conversion of these magnitudes is performed to produce $F_1(r,\theta)$ and $F_2(r,\theta)$. The $r$ coordinate of these functions is now logarithmically scaled to form $F_1(\exp\rho,\theta)$ and $F_2(\exp\rho,\theta)$. A second Fourier transform is carried out to produce the Mellin transform of $F(r,\theta)$ in $r$ and the Fourier transform in $\theta$. The resultant functions being $M_1(\omega_\rho,\omega_\theta)$ and $M_2(\omega_\rho,\omega_\theta)$. The conjugate Mellin transform of $F(r,\theta)$ which is $M_1^*(\omega_\rho,\omega_\theta)$ is formed and, for example, recorded as a suitable transparency. This can be readily accomplished by conventional holographic spatial filter synthesis methods which involve Fourier transforming $F_1(\exp\rho,\theta)$ and recording the light distribution pattern produced when a plane wave interferes with this transformation.

Figure 5:
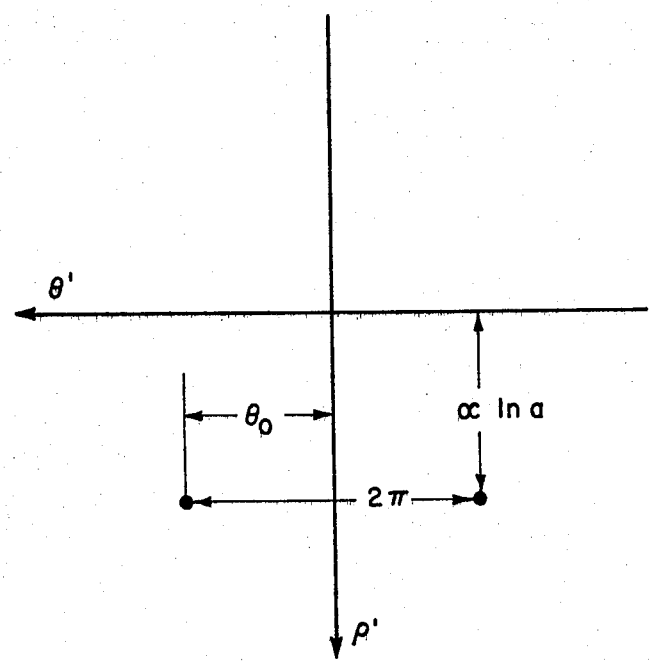
FIG. 5 shows the correlation peaks appearing in the output plane of the correlator of FIG. 4.

The correlation operation involves locating the function $F_2(\exp\rho,\theta)$ at the input plane of a conventional frequency plane correlator and positioning the conjugate Mellin transform recording $M_1^*(\omega_\rho,\omega_\theta)$ at the frequency plane. The light distribution pattern leaving the frequency plane when the input plane is illuminated with a coherent light beam has as one of its terms $M_1^*M_2$ and this product when Fourier transformed completes the cross-correlation process. The correlation of the two input functions in this method appears as two cross-correlation peaks, and the sum of their intensities is equal to the autocorrelation peak. Thus, the correlation is performed without loss in the signal-to-noise ratio. As mentioned hereinbefore, the coordinates of these cross-correlation peaks, as shown in FIG. 5, provides an indication of the scale difference, "*a*", and amount of rotation between the two functions $\theta_0$.

Figure 4:
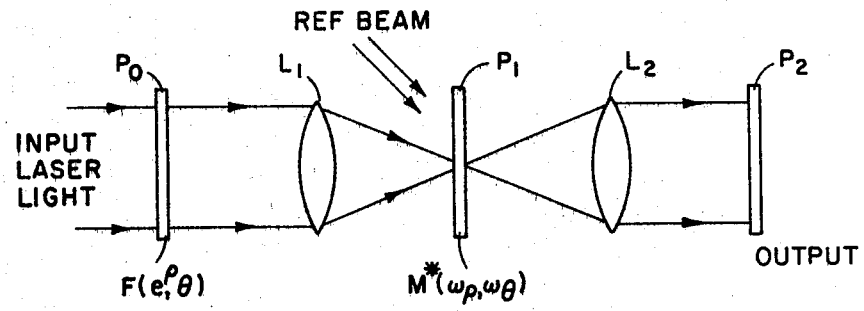
FIG. 4 shows a correlation configuration for practicing the method of FIG. 3.

FIG. 4 shows a frequency plane correlator for forming the conjugate Mellin transform $M_1^*(\omega_\rho,\omega_\theta)$ and for performing a cross-correlation operation utilizing a recording of this transform. In applicants' co-pending application, identified hereinbefore, there is disclosed a procedure for producing a hologram corresponding to this conjugate Mellin transform, and, as noted therein, the process involves producing at the input plane $P_0$, an image corresponding to the function $F_1(\exp\rho,\theta)$. This image may be present on the target of an EALM tube as an appropriate transmittance pattern. Alternatively, it may be available as a suitable transparency. In any event, the input function is illuminated with a coherent light beam from a laser source, not shown, and Fourier transformed by lens $L_1$. Its transform $M_1(\omega_\rho,\omega_\theta)$ is interferred with a plane reference wave which is incident at an angle $\Psi$ and the resultant light distribution pattern is recorded. One of the four terms recorded at plane $P_1$ will be proportional to $M_1^*(\omega_\rho,\omega_\theta)$.

In carrying out the correlation, the reference beam is blocked out of the system. The hologram corresponding to the conjugate Mellin transform $M_1^*(\omega_\rho,\omega_\theta)$ is positioned in the back focal plane of lens $L_1$ at plane $P_1$. The input image present at plane $P_0$ now corresponds to the function $F_2(\exp\rho,\theta)$ which again may be the transmittance pattern on an EALM tube or suitable transparency. When the coherent light beam illuminates the input plane $P_0$, the light distribution incident on plane $P_1$ is $M_2(\omega_\rho,\omega_\theta)$. One term in the distribution leaving plane $P_1$ will, therefore, be $M_2M_1,^*$ and the Fourier transform of this product is accomplished by lens $L_2$. In the output plane $P_2$, as shown in FIG. 5, two cross-correlation peaks occur. Two photodetectors spaced by $2\pi$ may be utilized to detect these peaks and, as indicated hereinbefore, the sum of their amplitudes will be equal to the autocorrelation peak produced when the two images being compared have the same position, scale and orientation.

In the correlation method depicted in FIG. 3, the conjugate Mellin transform $M_1^*(\omega_\rho,\omega_\theta)$ was produced and utilized in the frequency plane of the correlator of FIG. 4. However, it should be understood that the method can also be practiced by utilizing the conjugate Mellin transform $M_2^*(\omega_\rho,\omega_\theta)$ at $P_1$ forming the product $M_1M_2^*$ and Fourier transforming it to complete the cross-correlation process.

What is claimed is:

1. A method for correlating two functions $f_1(x,y)$ and $f_2(x,y)$ which are scaled and rotated versions of each other, comprising the steps of obtaining $|F_1(\omega_x,\omega_y)|$, and $|F_2(\omega_x,\omega_y)|$, the magnitudes of the Fourier transforms of these functions;

performing a polar coordinate conversion on $|F_1(\omega_x,\omega_y)|$ and $|F_2(\omega_x,\omega_y)|$ thereby to obtain the functions $F_1(r,\theta)$ and $F_2(r,\theta)$;

logarithmically scaling the coordinate $r$ in the functions $F_1(r,\theta)$ and $F_2(r,\theta)$ thereby to obtain the functions $F_1(e^\rho,\theta)$ and $F_2(e^\rho,\theta)$;

Fourier transforming $F_1(e^\rho,\theta)$ and $F_2(e^\rho,\theta)$ thereby to obtain the Mellin transforms $M_1(\omega_\rho,\omega_\theta)$ and $M_2(\omega_\rho,\omega_\theta)$;

obtaining the conjugate Mellin transform $M_1^*(\omega_\rho,\omega_\theta)$;

producing the product $M_1^*M_2$;

Fourier transforming said product, all of the aforementioned steps being performed by optical or electro-optical means; and recording on film the results of said last-mentioned Fourier transformation.

2. In a method as defined in claim 1 wherein said function $f_1(x,y)$ is in the form of an optical transmittance pattern and the magnitude of the Fourier transform of this function $F_1(\omega_x,\omega_y)$ is obtained by positioning said pattern in the front focal plane of a lens and illuminating said pattern with coherent light whereby the light distribution pattern in the back focal plane of said lens corresponds to Fourier transformation of said function.

3. In a method as defined in claim 1 wherein the conjugate Mellin transform $M_1^*(\omega_\rho,\omega_\theta)$ is recorded as a film transparency of the interference pattern between a reference plane wave and a light distribution pattern corresponding to $F_1(e^\rho,\theta)$.

4. In a method as defined in claim 1 wherein the product $M_1^*M_2$ is produced by positioning said film transparency having $M_1^*(\omega_\rho,\omega_\theta)$ recorded thereon in the front focal plane of a lens and illuminating said film with a light distribution pattern produced by Fourier transforming $F_2(e^\rho,\theta)$.

5. In a method as defined in claim 1 wherein the conjugate Mellin transform $M_2^*(\omega_\rho,\omega_\theta)$ is obtained by having a reference wave interfere with a Fourier transformation of $F_2(e^\rho,\omega)$, the resultant interference pattern containing a term corresponding to said conjugate.

6. In a method as defined in claim 1 wherein the product $M_1M_2^*$ is obtained by illuminating a film transparency having $M_2^*$ recorded therein with the light distribution pattern resulting from Fourier transforming $F_1(e^\rho,\theta)$.

7. A method for correlating two functions $f_1(x,y)$ and $f_2(x,y)$ which are scaled and rotated versions of each other, comprising the steps of producing an optical representation of $|F_2(\omega_x,\omega_y)|$, the magnitude of the Fourier transform of $f_2(x,y)$;

performing a polar coordinate conversion on this representation of $|F_2(\omega_x,\omega_y)|$ thereby to obtain an optical representation of the function $F_2(r,\theta)$;

logarithmically scaling the coordinate $r$ in the function $F_2(r,\theta)$ thereby to obtain an optical representation of the function $F_2(e^\rho,\theta)$;

Fourier transforming $F_2(e^\rho,\theta)$ thereby to obtain a light distribution pattern corresponding to the Mellin transform $M_2(\omega_\rho,\omega_\theta)$;

pouring a film transparency having an interference pattern recorded therein which contain a term that is proportional to the conjugate Mellin transform $M_1^*(\omega_\rho,\omega_\theta)$;

illuminating said film transparency with said light distribution pattern thereby to produce a light distribution pattern corresponding to the produce $M_1{*}M_2$;

Fourier transforming said last-mentioned light pattern; and recording the results thereof.

8. Apparatus for correlating two functions $f_1(x,y)$ and $f_2(x,y)$ which are shifted, scaled and rotated versions of each other, comprising in combination an optical correlator having an input plane $P_0$, a frequency plane $P_1$ and an output plane $P_2$;

a film transparency having an interference pattern recorded therein which contain a term proportional to the conjugate Mellin transform $M_2{*}(\omega_\rho,\omega_\theta)$, said film transparency being positioned at plane $P_1$;

means for creating a light pattern leaving plane $P_0$ that corresponds to $F_1(e^\rho,\theta)$, said light pattern being Fourier transformed by lens means within said correlator located between planes $P_0$ and $P_1$ and the illumination of said film transparency by the resultant light pattern producing a light pattern leaving plane $P_1$ that corresponds to the product $M_2{*}(\omega_\rho,\omega_\theta)\ M_1(\omega_\rho,\omega_\theta)$, said last-mentioned light pattern being Fourier transformed by other lens means within said correlator located between planes $P_1$ and $P_2$; and means positioned at plane $P_2$ for recording the results of said last-mentioned Fourier transformation.

9. Apparatus for correlating two functions $f_1(x,y)$ and $f_2(x,y)$ which are shifted, scaled and rotated versions of each other, comprising optical means for Fourier transforming $f_1(x,y)$ so as to obtain $|F_1(\omega_x,\omega_y)|$, the magnitude of the Fourier transform of this function;

means for performing a polar coordinate conversion on $|F_1(\omega_x,\omega_y)|$ so as to obtain the function $F_1(r,\theta)$; means for logarithmically scaling the $r$ coordinate in the function $F_1(r,\theta)$ so as to obtain $F_1(e^\rho,\theta)$, $|F_1(\omega_x,\omega_y)|$, $F_1(r,\theta)$ and $F_1(e^\rho,\theta)$ occurring as optical images;

optical means for Fourier transforming $F_1(e^\rho,\theta)$ so as to obtain a light pattern corresponding to the Mellin transform $M_1(\omega_\rho,\omega_\theta)$;

a film transparency having an interference pattern recorded therein which contains an optical representation of the conjugate Mellin transform $M_2{*}(\omega_\rho,\omega_\theta)$;

means for illuminating said film transparency with said light pattern so as to obtain a light pattern corresponding to $M_1M_2{*}$;

optical means for Fourier transforming said last-mentioned light pattern; and means for recording the results thereof.

10. The apparatus as defined in claim 9 wherein said means for creating a light pattern leaving plane $P_0$ that corresponds to $F_1(e^\rho,\theta)$ includes means for Fourier transforming an optical representation of the function $f_1(x,y)$ so as to obtain $|F_1(\omega_x,\omega\lambda_y)|$, the magnitude of the Fourier transform of this function;

means for performing a polar coordinate conversion on the light pattern resulting from said transformation so as to obtain a light pattern cooresponding to the function $F_1(r,\theta)$; and means for logarithmically scaling the $r$ coordinate in said last-mentioned light pattern thereby to obtain a light pattern corresponding to $F_1(e^\rho,\theta)$.

* * * * *